United States Patent [19]

Hrus et al.

[11] Patent Number: 4,787,423

[45] Date of Patent: Nov. 29, 1988

[54] METHOD OF AND DEVICE FOR INSERTING WEFT YARN IN JET LOOMS

[75] Inventors: Miroslav Hrus; Ladislav Sevcik, both of Liberec, Czechoslovakia

[73] Assignee: ELITEX Koncern Textilniho Strojirenstvi, Liberec, Czechoslovakia

[21] Appl. No.: 882,610

[22] Filed: Jul. 7, 1986

[30] Foreign Application Priority Data

Jul. 5, 1985 [CS] Czechoslovakia ..... PV 5060-85

[51] Int. Cl.[4] ..... D03D 47/28

[52] U.S. Cl. ..... 139/435

[58] Field of Search ..... 139/435; 226/97

[56] References Cited

U.S. PATENT DOCUMENTS

| | | | |
|---|---|---|---|
| 3,465,791 | 9/1969 | Mullekom | 139/435 |
| 3,821,972 | 7/1974 | Svaty et al. | 139/435 |
| 4,244,402 | 1/1981 | Hasegawa et al. | 139/435 |
| 4,290,460 | 9/1981 | Deborde | 139/435 |
| 4,344,465 | 8/1982 | Hasegawa et al. | 139/435 |
| 4,487,236 | 12/1984 | Gunneman | 139/435 |
| 4,655,262 | 4/1987 | Scheffel et al. | 139/435 |

FOREIGN PATENT DOCUMENTS

| | | | |
|---|---|---|---|
| 1941550 | 2/1970 | Fed. Rep. of Germany | 139/435 |

*Primary Examiner*—Henry S. Jaudon

*Attorney, Agent, or Firm*—Klein & Vibber

[57] ABSTRACT

The present invention relates to a method of and apparatus for inserting weft yarn in jet looms, in which the weft yarn is inserted by the action of an inserting fluid jet and entraining fluid jets. The weft yarn is projected by the inserting fluid jet into the carrying jet field made up of at least two opposite systems of entraining fluid jets disposed close to and in front of the reed of the loom; the weft yarn is discontinually supported inside the carrying jet field, and the carrying jet field is simultaneously stabilized by withdrawing a part of the fluid from the boundary layer of the jet field.

8 Claims, 3 Drawing Sheets

METHOD OF AND DEVICE FOR INSERTING WEFT YARN IN JET LOOMS

FIELD OF THE INVENTION

The present invention relates to a method of and an apparatus for, inserting weft yarn in jet looms in which the weft yarn is inserted into the shed by means of a primary or inserting fluid jet and secondary or entraining fluid jets downstream of the primary jet.

BACKGROUND OF THE INVENTION

At present, generally two kinds of weft inserting methods and apparatus in jet looms are known. In accordance with the first such method and apparatus, the weft yarn is inserted into the shed by a single fluid jet. However, this is disadvantageous for the insertion of weft threads over large weaving widths, since the fluid velocity, by which the weft thread is being inserted into the shed, is reduced as it flows freely into the shed space approximately exponentially in dependence upon the distance from the orifice of the inserting nozzle. The use of a confusor, that is, a jet guiding means, improves weft insertion since along the guiding means the velocity of the fluid jet is reduced in upon the distance from the nozzle orifice approximately linearly. In spite of this, weaving widths up to two meters remain a classical limit to weft insertion by means of a single fluid jet.

The second manner of weft insertion employs, beside the inserting fluid jet, secondary, weft entraining fluid jets which, either simultaneously, or successively, aid in the insertion of the weft yarn into the shed. A plurality of successive weft insertion means such as nozzles situated within the shed of the loom are known; by means of such secondary nozzles, the insertion of the weft yarn throughout the whole weaving width is assured.

The secondary nozzles are arranged e.g. on a beam in either the upper or lower part of the shed. In the course of weft yarn insertion, fluid flows from the secondary nozzle orifices, such fluid entraining weft and causing it to be fed through the shed. An assembly of secondary or auxiliary nozzles is used, arranged near one another in a varying geometrical arrangement. The secondary nozzles can be either firmly connected to the reed of the loom, or driven by means of a mechanism which controls their penetration into the shed. An arrangement of secondary nozzles in the form of a asymmetrical saw-shaped bar is also known, which is pressed into the open shed against the warp threads. In the shorter walls of the saw-shaped bar, which are approximately vertical, drain openings of the nozzles are arranged, the direction of the drain openings being approximately in the direction of weft insertion. The nozzle thus arranged can be situated at the lower side or on both sides of the weaving shed.

However, the above-described known methods and apparatus have not proved to be entirely satisfactory from the viewpoint of weft yarn insertion. In reliable weft yarn insertion, the weft yarn must be fed in it insertion throughout the entire weaving width without loops, breakages and short picks. When eliminating loops in the weft caused by the warp, by trapping them in an uneven shed, then the motion of the weft thread, particularly that of its front end, is decisive from the view point of the proper insertion of the weft yarn. The weft yarn should move, if possible, without oscillations to reduce the possibility of its being trapped in the warp threads, to prevent its escape from the shed, etc.

In the insertion of weft yarn by means of a primary, inserting fluid jet and secondary, entraining fluid jets hitherto known, the tip of the weft yarn to be inserted is deflected from the direction of weft insertion. The geometrical arrangement of the secondary, entraining nozzle is, therefore, in addition to its primary action, i.e. the supporting of the weft insertion, simultaneously directed to a determination of a narrow weft passage space. There are known prior methods in which half of the weft yarn passage is determined by a plurality of plate-like guide members of various cross section, which are connected to the reed either fixedly, or movably. Upon weft insertion, such plate-like guide members are disposed in the shed and perform, together with the entraining nozzles, the directing of the weft yarn carrying fluid jet. The spacing between successive plate-like guide members varies from $10^{-1}$ to $10^{-4}$m, and their shape varies from an open one up to a closed cross section with an unthreading groove for the weft yarn. The entraining nozzles either form part of the plate-like guiding members, or are made separate from them.

It is also known that weft yarn insertion into a shed wherein the planes of the shed-forming threads are covered, both from above and from below by plates which are deflected upon beat-up. By covering the shed, an air channel is formed. This arrangement can be integrated with plate-like guide members and nozzles. For the purpose of stabilizing the weft yarn, air is sometimes sucked off from between the plates.

The above-described known arrangement are intended for stabilizing the position of the weft yarn by an aerodynamic action of the air jet in the center of the shed or in its proximity in such manner that no contact of the weft thread takes place either with the upper or the lower shed, as well as with the reed.

In another known arrangement, the plate-like guiding members are integrated into the reed in the form of shaped reed dents. In this arrangement, it is intended that the weft yarn be guided between two nose-shaped projections of the shaped reed dents.

Only some of the above-described known weft yarn inserting arrangements are in practical use because the others have either one or more practical disadvantages. Weft insertion through a confusor, that is, a plurality of plate-like guide members, constitutes no more than half of the weft inserting arrangement in use, since the confusor, upon penetrating the shed, scuffs and/or fibrillates the warp threads and damages them in various other manners. An acceptable reliability is achieved only with shorter insertion lengths. By using an entraining fluid jet system, however, one of the main advantages, low air consumption, of the confusor is lost.

The known inventions, which aim at maintaining the weft yarn in proximity to the shed by means of directing nozzles are disadvantageous because weft insertion takes place far from the first heddle, supporting shaft at such points, which might bring about a considerable risk of an uneven shed and of insertion failure resulting therefrom. The directing of nozzles and the stabilization of pressure in front thereof must be exactly defined. The application of guiding gliders, together with an increasing density, to a profile reed, which might be preferable, is secured mechanically. This is done by defining the path; however, this arrangement is extremely susceptible to changes in the adjustment of the direction of the outflow of the fluid and its pressure inside the nozzles. The profile reeds are expensive, vulnerable to wear and impairment, and must be frequently exchanged when changing the nature of goods being woven. The formation of a channel from plate-like members within the proximity of the shed, its interconnection with both the gliders and nozzles is clumsy, makes for increase attendance, and requires and additive mechanism.

The present invention has among its objects the removal to an extend hitherto unknown of the disadvantages of the prior art, without using a guiding channel, whether formed by a system of gliders, a profile reed, or a plurality of plate-like guide members.

SUMMARY OF THE INVENTION

In accordance with the present invention, weft yarn is inserted by means of a primary, inserting fluid jet, the weft yarn being inserted by an insertion fluid jet into carrying jet fields of at least two systems of entraining fluid jets, the weft yarn being discontinuously supported within the carrying jet field and the carrying jet field being simultaneously stabilized by carrying a part of the fluid from the boundary layer of the fluid field. The two or more systems of entraining jets are disposed opposite each other in parallel relationship with the weft thread located centrally between them.

For the purpose of achieving economy of pressure fluid and assuring the drawing through the shed of the weft yarn, it is advantageous to act upon the front section of the weft yarn to be inserted by the carrying jet field by the successive activation of the entraining air jets.

It is advantageous for certain types of weft yarn, e.g. thick wefts, when draining the part of the fluid from the entraining jets in the boundary layer of the jet field, to blow with further additional fluid jets, enhancing the ejection effect.

A simple apparatus for performing the method according to the present invention has the weft inserting nozzle arranged immediately in front of the plane of the reed, the entraining nozzles being distributed in at least two systems in front of the plane of the reed with the axes of the the discharge jets adjusted to be directed toward the reed at an acute angle relative to the plane where the reed dents constitute the support for the weft yarn and the gaps between the reed dents constitute a duct for discharging fluid from the boundary layer of the jet field. This is advantageous, because a flat, unprofiled reed can be used.

From the view point of efficiency, it is advantageous when the system is of the entraining nozzles spaced from the plane of the reed at a distance on the order of magnitude $10^{-3}$m, the diameter of the discharged opening of the entraining nozzles lying within the order of magnitude $10^{-3}$ to $10^{-4}$m, and the distances of the entraining nozzles of one system are elective to the training nozzles of the other system, lying within the order of magnitude $10^{-2}$ to $10^{-3}$m.

For the purpose of achieving economy of pressure fluid, it is advantageous to connect the entraining nozzles to the pressure fluid container by control valves.

For the purpose of improving the discharge of fluid from the boundary layer, it is advantageous to distribute a further system of additive nozzles along the rear wall of the reed, such additive nozzles being directed away from the plane of the reed at an acute angle with respect thereto.

The advantage of the method of and the apparatus for inserting a weft yarn according to the present invention consists particularly in that by the action of the carrying jet field, the weft yarn is carried along a planar, non-shaped reed in the defined shed space of a very small cross section. One of the main advantages consists in that the weft yarn is inserted by a carrying jet field, such field having a low degree of turbulence. The reliability and velocity of inserting weft yarn can be advantageously controlled by a mere geometrical arrangement and directing of the entraining nozzles. Weft insertion failures, which are caused by an insufficiently open shed of the warp yarns, are substantially reduced as the weft moves along the reed. The low air consumption produced by the invention is also advantageous, since the discharge openings of the nozzles are located at a minimum distance from the reed and their diameters are also of minimum dimension.

The method of and apparatus for inserting weft yarn according to the present invention is also advantageous in view of its simplicity, insensitivity to the quality of the weft yarn to be inserted, and the change of the reed dents, as well as making possible a successive control of entraining nozzles and the requirement of a minimum size of the open shed, which makes possible a reduction of the shaft lift and the trajectory reduction of the reed motion. Thus, reduction of forces in the shed mechanism is obtained, as well as a reduction of noise and vibration; all of these factors make possible an increase in the weaving speed of the loom.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
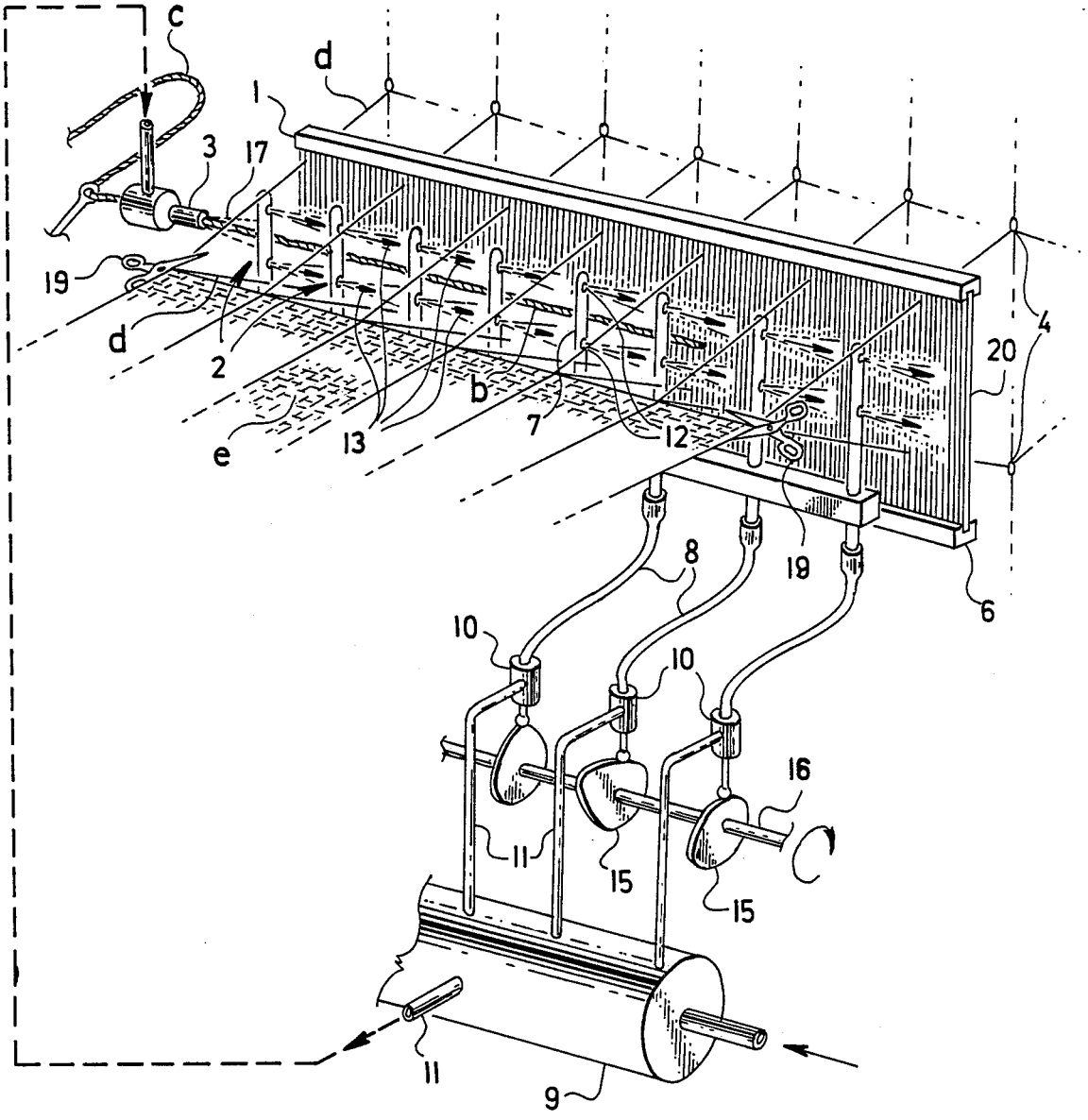
FIG. 1 is an axonometric view of a first preferred embodiment of the apparatus.
Figure 2:
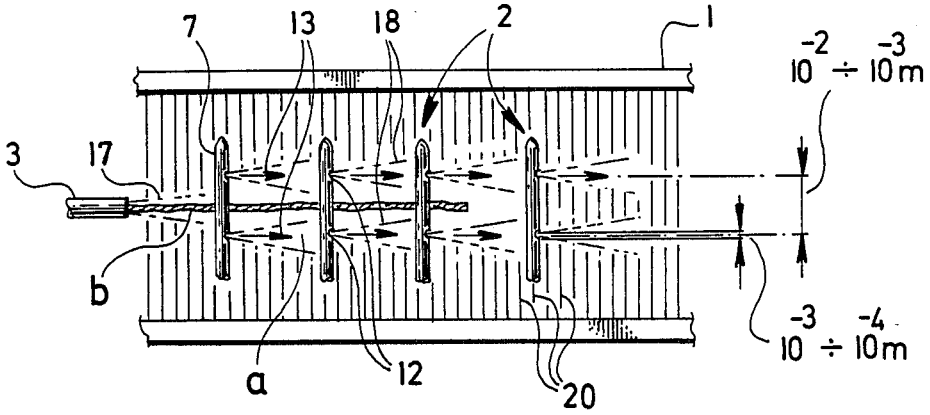
FIG. 2 is a view in front elevation of both the inserting and entraining nozzles of the apparatus shown in FIG. 1.
Figure 3:
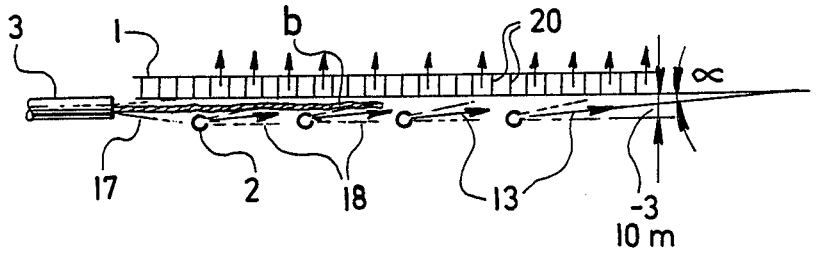
FIG. 3 is a view in plan of the reed and both the inserting and entraining nozzles are shown in the apparatus of FIG. 1.

Turning first to the embodiment of FIGS. 1, 2, and 3, the apparatus thereshown includes, in a simple embodiment, a reed 1, in front of which there are arranged on a bar 6 two systems of entraining nozzle openings 12. Immediately in front of the plane reed 1 is mounted an inserting nozzle 3 of conventional design, the weft yarn b being fed from a metering device (not specifically shown). For the purpose of simplification, the metering device is indicated by the bending C of the weft yarn b upstream of the inserting nozzle 3.

The bar 6 is mounted in either the upper or lower part of the shed, either firmly connected to the reed or movable as well known in the art, for example as shown in U.S. Pat. Nos. 4,290,460; 4,344,465; 4,244,402,; or 4,487,236. The nozzles are mounted on the bar also in a conventional way such as by a threaded mount or by passing through a bore and held with a set screw as shown in the above mentioned patents. The nozzles are supplied as shown in FIG. 1 and as described herein below.

The shed is formed by warp threads which are healded in heedle shafts 4. The heedle shafts 4 are fixed in shaft frames (not illustarted). These shaft frames are raised in a conventional shed forming device.

A plurality of entraining nozzles 2 are distributed along the whole shed width, said shed being built up in a known manner by heddle shafts 4 (FIG. 1) which are represented diagrammatically; in FIG. 1 there are also shown in the same manner a cutting device 19 for the weft and woven fabric e.

Two (upper and lower) systems of entraining nozzle openings 12 are shown connected to a pressure fluid container 9 by means of hoses 8, control valve 10, and distributing pipe 11. In a similar manner, the inserting nozzle 3 is also connected to the pressure container 9 by means of a distributing pipe 11 and a control valve 10.

The entraining nozzles 2 are made, as shown in FIG. 1, of tubes 7 which are closed at one end and are inserted into hoses 8 below the bar 6 at the other end. As shown in FIG. 2, in each nozzle 2, there are provided, one above the other, and spaced at a distance of $10^{-2}$ to $10^{-3}$m, two openings 12 of a diameter within the orders from $10^{-3}$ to $10^{-4}$m. The opening 12, which is nearer to the closed ends of tubes 7 (FIG. 1) form one system of the entraining nozzles 2, the remaining opening 12 forming the other system of the entraining nozzles 2. There can be more openings 12 in the tube 7, and thus also more systems of entraining nozzles 2, but it is also necessary to take into account the higher consumption of pressure fluid in such cases. In order to maintain the pressure consumption as low as possible, the openings 12, as shown in FIG. 3, are directed in such manner that the axes 13 of the entraining fluid jet emerging from the openings 12 are directed at an acute angle $\alpha$ with respect to the plane of the reed 1, the distance of the tubes 7 from the reed 1 is within the order of $10^{-3}$m.

With the system of entraining nozzles 2 as described above, it is not necessary to arrange bar 6 relative to the beat-up of weft yarn b by the reed 1 movably, e.g. in a manner similar to the bar in looms hitherto known having a confusor, said bar carrying the confusor gliders. It is possible also to arrange the entraining nozzles 2 also to move together with reed 1. Thus, e.g. as shown in the second embodiment in FIG. 4, the tubes 7 of one system of entraining nozzles 2 may be mounted at the upper part of reed 1 and the entraining nozzles 2 of the other system maybe mounted at the lower part of reed 1 and it is possible to arrange the entraining nozzles 2 of one system longitudinally offset relative to the entraining nozzles 2 of the other system along the length of the shed. The beat-up of the inserted weft yarn b is made possible by the gap between systems of entraining nozzles 2. The distance of the entraining nozzles 2 in the embodiment of FIGS. 4 and 5 from reed 1, the adjustment of their discharged opening 12 with relation to reed 1, their diameters, as well as the connections to the pressure fluid container 9, are chosen in manners similar to those in the first described embodiment of FIGS. 1, 2, and 3.

Figure 6:
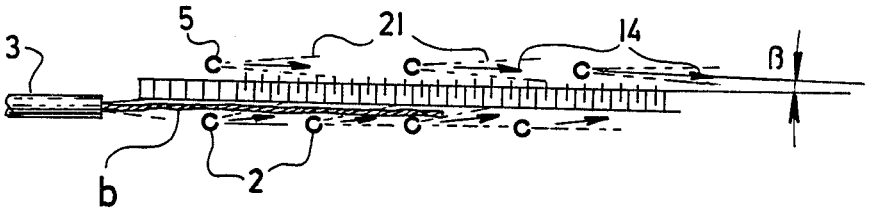
FIG. 6 is a view in plan of a third embodiment of the invention, such embodiment providing additional nozzles disposed at the rear of the reed for improving the discharging of the boundary layer of the jet field.

In the case of the necessity of increasing the efficiency of the entraining nozzles 2, it is advantageous to employ the third illustrative embodiment of the invention shown in FIG. 6. This embodiment differs from the preceding embodiment in that a system of additional nozzles 5 is arranged behind reed 1, the axes 14 of the discharge of the jets 21 from such additional nozzles 5 being directed at an acute angle $\beta$ with respect to the plane of the reed 1. It can be seem that the discharged jets 21 from additional nozzles 5 tend to scuttle the boundary fluid which passes through the reed 1, thereby increasing the speed and volume of the fluid escaping from the boundary layer. The additional nozzles 5 are advantageously connected to the pressure fluid container 9 via control valves 10, which thus can be common for the neighboring additional nozzle 5 and the entraining nozzle 2.

The control of the control valves 10 can be performed in various manners. In the examplary embodiment illustrated in FIGS. 1, 2, and 3, the control valves 10 are controlled mechanically by cams 15, which are adjustably mounted on cam shaft 16, shaft 16 being driven by the main shaft (not shown) of the loom in accordance with the procedure of the weaving process. It is possible to adjust the time of opening of the control valves 10 by an adjustable arrangement of cams 15.

The above-described embodiments of the apparatus of the invention operates as follows:

Upon opening the control valves 10 by cams 15, the inserting nozzle 3 connected to container 9 and thus brought into operation. The weft yarn b, which is inserted by the inserting fluid jet 17, is withdrawn from the metering device c into the carrying jet field a, formed in the open shed d by two systems of entraining fluid jets 18, emerging from the openings 12 of the entraining nozzle 2 upon their connection to the container 9 by the control valves 10. In the carrying jet field a, the weft yarn b is moved within a space defined by the plane of reed 1 and the conically expanding entraining fluid jets 18, said space being determined by the distribution of pressure in the entraining fluid jets, which expand upon emerging from the opening 12 of the entraining nozzles 2.

Figure 7:
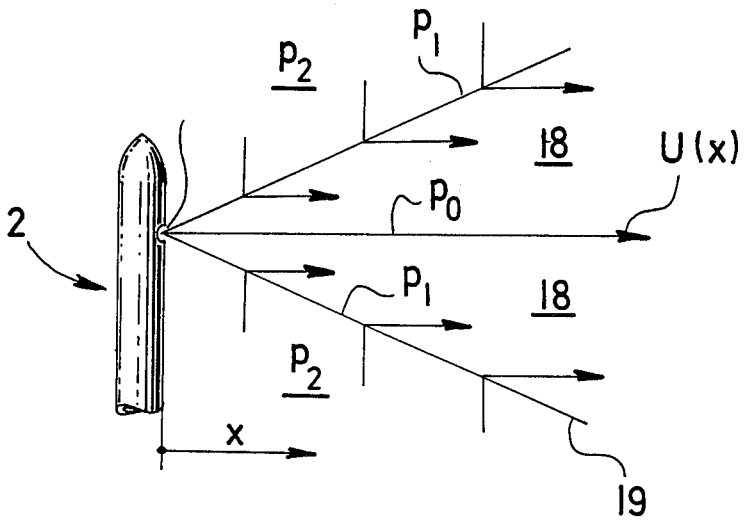
FIG. 7 is a diagram of the pressure distribution in the fluid emerging from an entraining nozzle.

The distribution of pressure in the conically expanding entraining fluid jet 18, emerging from the opening 12 of the entraining nozzle 2, is depicted in FIG. 7. In such figure, $P_0$ denotes the pressure in the axis of the entraining jet, $P_1$ denotes the pressure at the boundary 19 between the entraining fluid jet and the surrounding atmosphere, and $P_2$ denotes the pressure of the surrounding atmosphere.

Figure 4:
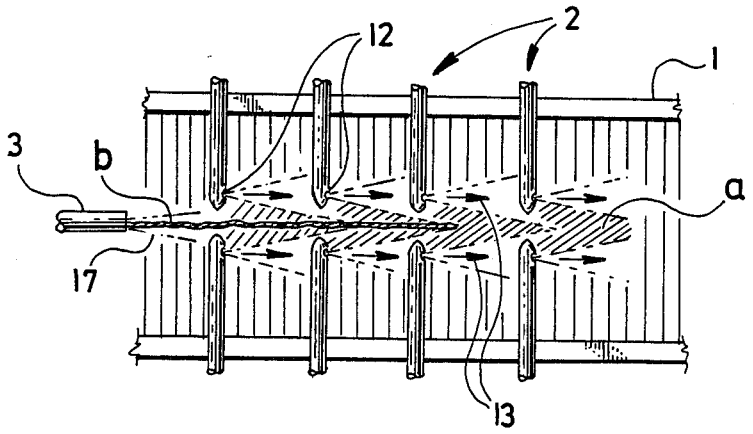
FIG. 4 is a front elevation of a second embodiment of the invention, such figure showing an alternative arrangement of the entraining nozzles.

It holds true that $P_0 > P_1 > P_2$. The differences of pressure are evoked by the friction effect of the jet about the stationary surrounding atmosphere, the pressure differences $P_0 - P_1$, $P_1 - P_2$, $P_0 - P_2$, being among others, proportional to the square of axial velocity of the jet $U^2(x)$ which decreases approximately exponentially with the distance x from the distance of the nozzle. The weft yarn b, which approaches the conically expanding entraining fluid jet 18 from the outer side, is expelled back due to the acting pressure gradient. This effect decreases at the same velocity as the pressure gradient, i.e. approximately with the square of distance x from the opening 12 of the entraining nozzle 2. By distributing the nozzles along the reed 1 in the shed of warp yarn b and by distributing the entraining nozzles 2 into the two systems as shown in FIGS. 1 and 2 and 4, a stabilized carrying jet field a is formed as the result of the entraining jets 18 of both the preceding and following entraining nozzles 2. By a carrying jet field a formed in that manner, the weft yarn b is drawn along the reed 1, being discontinually supported by its dents 20, as shown in FIG. 6. The stability of the motion of weft thread b along reed 1 is secured so that it avoids the boundary layer of the carrying jet field a, which is braked by the reed dents 20 of the reed 1, but the boundary layer thus tending to grow and disturb the stability of the carrying jet field a. The growth of the boundary layer of the carrying jet field a along reed 1 is avoided by exhaustion of a part of the fluid from the boundary layer of the jet field a behind reed 1. Such exhaustion of the fluid from the boundary layer of the jet field takes place through the gaps between the dents 20 of reed 1. The thickness of the boundary layer of the jet field a can be controlled by changing the acute angle $\alpha$ of axes 13 of the entraining fluid jets (FIG. 3) relative to the plane of reed 1, or possibly by changing the acute angle $\beta$ of the axes 13 of the outflow jets 21 (FIG. 6) of the additional nozzles 5.

Figure 5:
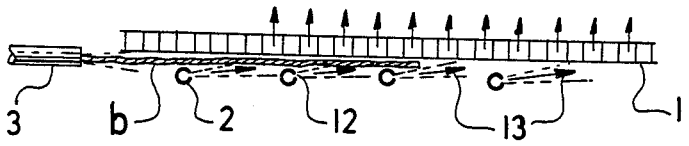
FIG. 5 is a view in plan of the embodiment of FIG. 4.

FIG. 3 does not represent discontinuous support of the weft by the the reed dents. Rather, FIG. 3 shows the insertion of the weft into the carrying jet field in proximity of inserting nozzle 3, which is arranged parallely with the reed. In the proximity of the inserting nozzle 3, the weft maintains this parallel direction. At a longer distance from inserting nozzle 3, however, the weft must be discontinuously supported by, e.g. the reed dents, as represented in FIGS. 5 and 6.

From the view point of insertion and economy of the pressure fluid, it is advantageous to open, by adjustment of cams 15, the entraining nozzles 2 successively in such manner that the carrying jet field a surrounds the front part of the weft yarn b, as shown in FIGS. 4 and 6. Upon insertion of the weft into the shed, the weft yarn b is beaten up to the selvedge of fabric e and cut off at both ends of the fabric by a cutting device 19, whereupon the whole cycle is repeated. The reed is preferred to be a smooth reed 1, without any shape projections on the system of dents 20, or otherwise shaped dents 20 e.g. as by their being bent.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. Method of inserting weft yarn in jet looms, in which the weft yarn is inserted by the action of inserting fluid jet and entraining fluid jets, wherein the weft yarn is projected by the inserting fluid jet into a carrying field of at least two systems of entraining fluid jets and is supported discontinuously in the carrying field upon the simultaneous stabilization of the carrying field by exhaustion of a part of the fluid from a boundary layer of the carrying field, wherein the exhaustion of a part of the fluid from the boundary layer of the carrying field is supported by activation of further fluid jets.

2. Method according to claim 3, wherein at least two systems of entraining fluid jets are disposed parallel, and on opposite sides of the path of the inserted weft thread.

3. Method according to claim 2, wherein the jet loom includes a reed, and at least two systems of entraining fluid jets are disposed close to the forward surface of the reed, and the part of the fluid exhausted from the boundary layer is discharged through the reed.

4. Method of inserting weft yarn in jet looms, in which the weft yarn is inserted by the action of inserting fluid jet and entraining fluid jets, wherein the weft yarn is projected by the inserting fluid jet into a carrying field of at least two systems of entraining fluid jets and is supported discontinuously in the carrying field upon the simultaneous stabilization of the carrying field by exhaustion of a part of the fluid from a boundary layer of the carrying field, wherein the carrying field acts upon the front section of the inserted weft yarn by successive activation of the entraining fluid jets, and wherein the exhaustion of a part of the fluid from the boundary layer of the carrying field is supported by activation of further fluid jets.

5. Method of inserting weft yarn in jet looms, in which the weft yarn is inserted by the action of inserting fluid jet and entraining fluid jets, wherein the weft yarn is projected by the inserting fluid jet into a carrying field of at least two systems of entraining fluid jets and is supported discontinuously in the carrying field upon the simultaneous stabilization of the carrying field by exhaustion on a part of the fluid from a boundary layer of the carrying field, wherein at least two systems of entraining fluid jets are disposed parallel, and on opposite sides of the path of the inserted weft thread, wherein the jet loom includes a reed, and at least two systems of entraining fluid jets are disposed close to the forward surface of the reed, and the part of the fluid exhausted from the boundary layer is discharged through the reed, and wherein the exhaustion of the part of the fluid from the boundary layer is aided by activation of further jets upon the rear surface of the reed.

6. Apparatus for inserting weft yarn in jet looms, comprising an inserting nozzle, entraining nozzles, and a reed having spaced dents, the inserting nozzle being arranged immediately in front of the plane of the reed, and the entraining nozzles being divided into at least two systems in front of the plane of the reed and adjusted with the axes of the entraining jets at an acute angle toward the plane of the reed, while the dents of the reed form supports for the weft yarn and the gaps between the dents of the reed form a guide for discharging fluid from the boundary of the jet field, wherein along the rear wall of the reed, a further system of additional nozzles is distributed of which the axes of the additional nozzles being adjusted so as to be directed at an acute angle away from the plane of the reed.

7. Apparatus as claimed in claim 6, wherein the system of entraining nozzles are spaced from the plane of the reed at a distance in the order of 10−3m, the diameter of the discharged openings of the entraining nozzles being within the order of $10^{-3}$ to $10^{-4}$m, and the distance of the entraining nozzles of system relative to the entraining nozzles of the other systems being within the order of $10^{-2}$ to $10^{-3}$m.

8. Apparatus as claimed in claim 6, wherein the entraining nozzles are connected to a container of pressure fluid via control valves.

* * * * *